US006609530B1

(12) United States Patent
Koza

(10) Patent No.: US 6,609,530 B1
(45) Date of Patent: Aug. 26, 2003

(54) PROCESS AND APPARATUS FOR TREATING A CONTINUOUS STRIP MATERIAL

(75) Inventor: Walter Koza, Baden (AT)

(73) Assignee: Andritz AG, Graz (AT)

( * ) Notice: Subject to any disclaimer, the term of this patent is extended or adjusted under 35 U.S.C. 154(b) by 129 days.

(21) Appl. No.: 09/654,349

(22) Filed: Sep. 1, 2000

(30) Foreign Application Priority Data

Sep. 3, 1999 (AT) ..... A 1518/99

(51) Int. Cl.[7] ..... B08B 3/04

(52) U.S. Cl. ..... 134/56 R; 134/64 R; 134/122 R; 134/186

(58) Field of Search ..... 134/6 RR, 122 R, 134/186, 201, 137, 56 R, 58 R, 57 R

(56) References Cited

U.S. PATENT DOCUMENTS 3,032,890 A * 5/1962 Brick et al.
3,693,528 A * 9/1972 Frick et al.
3,733,992 A * 5/1973 Stievenart et al.
4,112,532 A * 9/1978 Catallo
4,465,086 A * 8/1984 Coppe et al.
4,475,259 A * 10/1984 Ishii et al.
4,577,949 A * 3/1986 Geyken et al.
4,807,653 A * 2/1989 Cipriano et al.
5,007,445 A * 4/1991 Pender
5,179,967 A 1/1993 Mattiussi ..... 134/60
5,248,372 A * 9/1993 McNamee
5,378,307 A * 1/1995 Bard et al.
5,528,788 A * 6/1996 Yamaoto et al.
5,803,981 A * 9/1998 Lodro
5,803,984 A 9/1998 Lordo et al. ..... 134/18

* cited by examiner

*Primary Examiner*—Frankie L. Stinson
(74) *Attorney, Agent, or Firm*—Roylance, Abrams, Berdo & Goodman, L.L.P.

(57) ABSTRACT

A rinsing process and apparatus for rinsing a continuous steel strip material includes a rinse tank positioned above a collection chamber for defining a rinsing station. The rinse tank includes spray nozzles for spraying rinse liquid onto the upper and lower surfaces of the advancing strip. Pinch rollers are provided at the receiving end and discharge end of the rinse tank. Movable seals are provided in the rinse tank to engage the pinch rollers to close the gap between the pinch rollers and the rinse tank to effectively close the liquid drain outlets of the rinse tank. A detecting device is provided to detect stoppage of the forward movement of the steel strip to actuate the seals and close the drain outlets of the rinse tank. A continuous supply of rinse liquid through the nozzles quickly raises the liquid level in the rinse tank to completely immerse the steel strip when the forward movement of the steel strip stops.

32 Claims, 4 Drawing Sheets

PROCESS AND APPARATUS FOR TREATING A CONTINUOUS STRIP MATERIAL

FIELD OF THE INVENTION

The present invention relates to a process and apparatus for post-treatment of a metal strip by spraying the metal strip with a rinsing liquid to prevent staining when the strip is stopped. More particularly, the invention relates to a rinsing process where the metal strip is completely covered with liquid when the metal strip is at a standstill. In addition, the invention refers to a device for implementing the process.

BACKGROUND OF THE INVENTION

The pickling of steel is a process for removing scale from the surface of the steel that is present after various forming operations. Continuous sheets of steel are typically carried through several acid baths by immersing the strip completely in the baths for sufficient time to remove the scale. It is necessary to remove the acid residue from the steel after the pickling step to prevent corrosion, staining or spotting of the surface.

Pickling plants for treating a continuous steel strip usually include a strip rinsing facility downstream of the acid pickling stage in order to remove any residual pickling acid still adhering to the surface of the strip as the strip exits the pickling section. This rinsing process can be implemented by spraying the rinsing liquid directly onto the strip. Alternatively, the strip can be rinsed by pulling the strip through a bath of the rinsing liquid. In plants where the rinsing liquid is sprayed through nozzles directly onto the strip, the strip surface suffers serious discoloration due to oxidation if the air and rinsing water are allowed to act on the strip simultaneously during prolonged stoppages of the strip movement through the rinse station. In order to alleviate this situation, it has been suggested that the rinsing liquid be applied through nozzles and that the station be flooded with the rinse liquid when the forward movement of the strip is interrupted. The station is flooded to a level to completely cover the steel strip, thereby preventing oxygen from contacting the steel strip during the stoppage. Complete immersion of the strip reduces the staining on the strip when the strip is stopped.

Such processes and devices are known, for example, in AT 404 472 and EP 788 843. These patents disclose closing a drain valve of the rinsing tank when the strip comes to a standstill. As a result, the rinsing tank fills up to an overflow edge located above the strip. The disadvantage here, however, is that it takes a relatively long time for the tank to fill, and thus, oxidation may still occur on the strip surface before the strip is completely immersed in the rinse liquid.

In order to remedy this disadvantage, EP 788 843 discloses re-routing the rinsing liquid feed from the nozzles to an inlet specially provided for this purpose when the strip comes to a standstill. Nevertheless, the time elapsing before the rinsing tank has filled is also fairly long in this case, thus the risk of discoloration due to oxidation remains.

SUMMARY OF THE INVENTION

The present invention is directed to a process and apparatus for rinsing a metal strip of material passing through a rinsing station while preventing corrosion and staining of the metal strip. More particularly, the invention is directed to a process and apparatus for spraying a rinse liquid onto a continuously moving metal strip and flooding the rinse station during stoppage of the advance of the metal strip. The rinse station is flooded quickly to cover the strip and prevent oxidation.

Accordingly, a primary object of the invention is to provide a process and apparatus for rinsing a metal strip while reducing the risk of oxidation and staining of the metal strip.

Another object of the invention is to provide a process and apparatus for rinsing a strip material and flooding the strip material with a rinse liquid using equipment that is economical and easy to assemble.

Another object of the invention is to provide a process and apparatus for rinsing a strip material with a rinse liquid where the advancing movement of the strip material is monitored and where the rinse station is quickly flooded with the rinse liquid when a stoppage of the strip material is detected.

A further object of the invention is to provide a process and apparatus for rinsing a strip material by spraying a rinse liquid onto the moving strip material and quickly immersing the strip material in a pool of the rinse liquid when the strip material is at a standstill.

Still another object of the invention is to provide a process and apparatus for rinsing a strip material by carrying the strip material from an inlet end to an outlet end of a rinse tank and closing the inlet and outlet ends of the rinse tank when the strip material is at a standstill to form a pool of the rinse liquid in the rinse tank and to immerse the strip material in the rinse liquid.

A further object of the invention is to provide a process and apparatus for rinsing a strip material by carrying the strip material between spaced apart pinch rollers in a rinse tank and closing the gap between the pinch rollers and the rinse tank when the strip material is at a standstill to prevent drainage of the rinse liquid in the tank and to form a pool and immerse the strip material in the rinse liquid.

Another object of the invention is to provide a process and apparatus for rinsing a strip material by spraying a rinse liquid in a rinse tank where the rinse tank has a relatively small volume so that the rinse tank can be flooded and the strip material can be immersed in the rinse liquid quickly when the strip material is at a standstill.

Still another object of the invention is to provide a process and apparatus for rinsing a strip material in a spray rinse tank having pinch rollers at an inlet end and an outlet end and pneumatically operated seals for closing a gap between the pinch rollers and the rinse tank to present draining of the rinse tank and to flood the strip material in a pool of the rinse liquid.

A further object of the invention is to provide a process and apparatus for rinsing a strip material by passing the strip material through a spray rinse tank having pinch rollers at an inlet end and an outlet end and hydraulically operated seals for closing a gap between the pinch rollers and the rinse tank to prevent draining of the rinse tank and to flood the strip material in the rinse liquid.

Another object of the invention is to provide a process and apparatus for rinsing a steel strip material by carrying the strip between opposing pinch rollers for supporting the strip and providing a rinse tank having a bottom wall closely spaced to the strip and extending between the pinch rollers for defining a flooding zone.

A further object of the invention is to provide a process and apparatus for rinsing a strip material in a spray rinse tank having a detector for detecting the speed of the strip material passing through the rinse tank and a delay mechanism for flooding the rinse tank with a rinse liquid after a predetermined time period after the strip material has come to a standstill.

A further object of the invention is to provide a process and apparatus for rinsing a steel strip in a spray rinse liquid about 5 seconds to about 2 minutes after the advance of the strip is stopped.

Another object of the invention is to provide a process and apparatus for rinsing a strip material having a plurality of spaced rinse tanks and a pair of pinch rollers positioned between adjacent rinse tanks for supporting the strip material where the rinse tanks have movable seals for contacting the pinch rollers to close the rinse tanks and form a pool to immerse the strip material in the rinse liquid.

These and other objects of the invention are basically attained by providing a process for rinsing a strip material comprising: feeding a strip material through a rinse station, spraying a rinse liquid onto the strip material within the rinse tank; and detecting a stoppage of the strip within the rinse station and closing the inlet and outlet of the rinse tank to form a rinse liquid pool in the rinse tank having a depth to immerse the strip material in the rinse tank during the stoppage. The rinse station has a rinse tank with an inlet for receiving the strip material and an outlet for discharging the strip material.

These and other objects of the invention are further attained by providing a process for rinsing a strip material, comprising: continuously feeding a strip material through a rinse tank, continuously spraying a rinse liquid onto the strip material carried through the tank; detecting a stoppage of the strip material being carried through the rinse tank; and closing the gap between the tank and the first and second pairs of pinch rollers to form a rinse liquid pool in the tank having a depth to immerse the strip material in the tank during the stoppage. The rinse tank has an inlet for receiving the strip material and an outlet for discharging the strip material. The rinse tank further has a first pair of pinch rollers disposed in the inlet and spaced from the tank to define a gap, and a second pair of pinch rollers disposed at the outlet and spaced from the tank to define a gap. The strip material is carried by the first and second pinch rollers through the tank.

The objects of the invention are still further obtained by providing a rinsing apparatus for rinsing a continuously advancing strip material. The apparatus comprises a rinse tank having an inlet for receiving a strip material, and an outlet for discharging the strip material. A plurality of spray nozzles are positioned in the rinse tank for supplying a continuous spray of rinse liquid onto the strip material within the rinse tank. A first sealing device is coupled to the inlet of the rinse tank and a second sealing device is coupled to the outlet of the rinse tank. The first and second sealing devices are positioned to close the inlet and outlet and cause the rinse liquid to pool in the rinse tank to a level to immerse the strip material in the rinse liquid.

The objects of the invention are yet further obtained by providing a rinsing apparatus for rinsing a continuously advancing steel strip. The apparatus comprises a plurality of rinse stations arranged in a direction of travel of the advancing steel strip. Each of the rinse stations comprises a rinse tank having an inlet for receiving the steel strip and an outlet for discharging the steel strip. A plurality of spray nozzles direct a spray of rinse liquid onto the steel strip. First upper and lower pinch rollers are at the inlet end of the rinse tank and define a first gap therebetween. Second upper and lower pinch rollers are at the outlet of the rinse tank and define a second gap therebetween. A first sealing device is coupled to the inlet of the rinse tank for closing the first gap. A second sealing device is coupled to the outlet of the rinse tank for closing the second gap. The first and second sealing devices selectively close the first and second gaps to cause the rinse liquid to pool in the rinse tank to cover the steel strip.

The objects, advantages and other salient features of the invention will become apparent from the following detailed description of the invention and the annexed drawings which form a part of this original disclosure.

BRIEF DESCRIPTION OF THE DRAWINGS

The following is a brief description of the drawings in which.

DETAILED DESCRIPTION OF THE INVENTION

Figure 1:
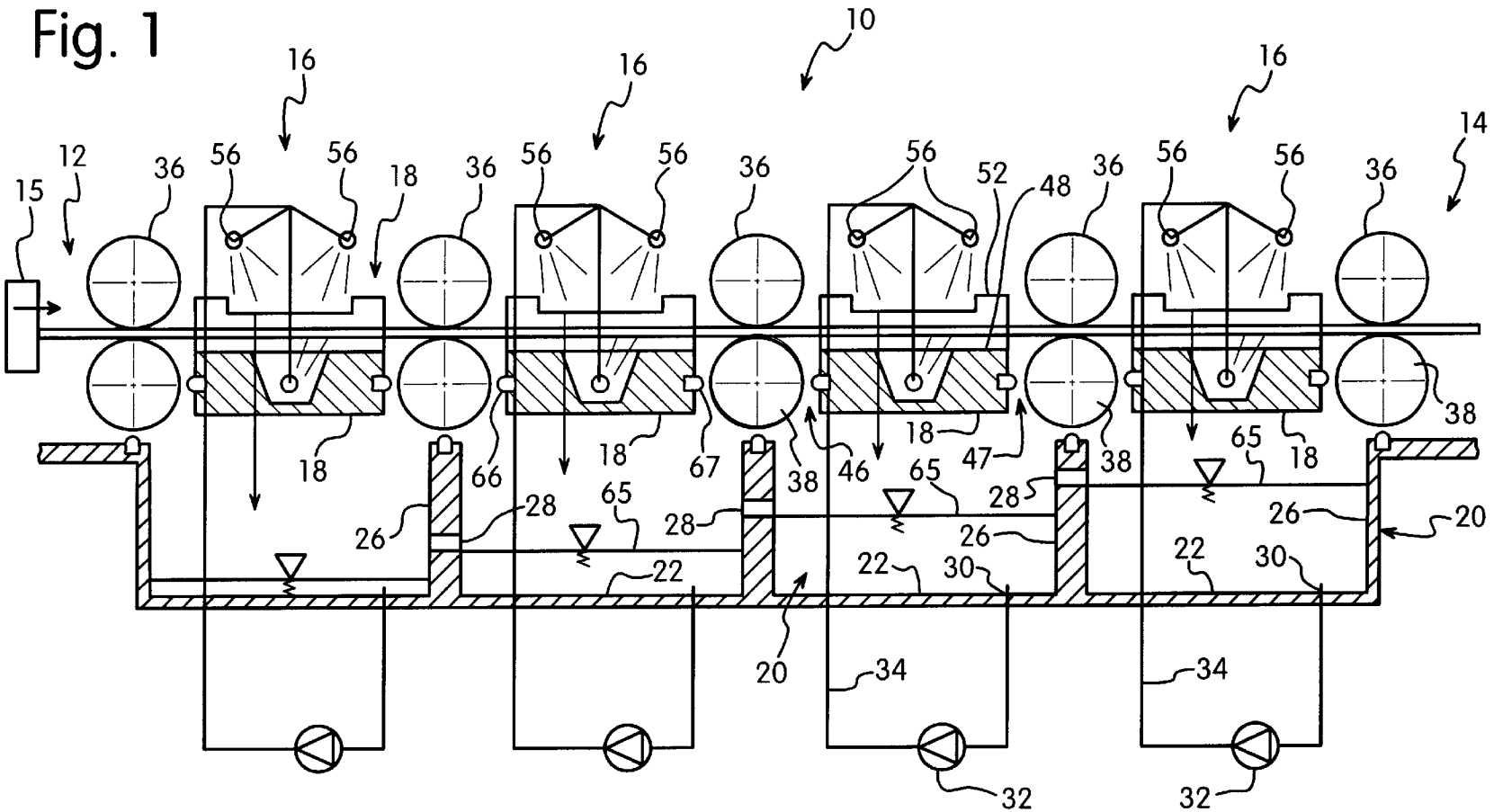
FIG. 1 is a side view of the rinse assembly in partial cross-section in a preferred embodiment of the invention.

The present invention is directed to a process and apparatus for rinsing a strip material by spraying a rinse liquid onto the strip material in a manner to prevent oxidation and staining of the strip. More particularly, the invention is directed to a spray rinsing apparatus for flooding a strip material in a rinse station when the strip material is at a standstill to prevent staining and oxidation of the strip.

Referring to the drawings, the spray rinsing apparatus 10 of the invention includes a receiving end 12 and a discharge end 14. Typically, spray rinsing apparatus 10 is positioned downstream of a treatment station and includes a feed device 15 for feeding a strip material through apparatus 10 at a substantially uniform speed. In preferred embodiments, spray rinsing apparatus 10 is assembled in combination with a pickling plant for receiving a continuous strip of metal, and particularly steel, as the strip exits the pickling tank.

Spray rinsing apparatus 10 includes a plurality of spray rinsing stations 16 spaced apart along the longitudinal direction of apparatus 10. As shown in FIG. 1, spray rinsing stations 16 are arranged along the running length of the strip material. Each spray station 16 includes a rinse tank 18 and a collection chamber 20 positioned directly below a respective rinse tank 18.

Collection chamber 20 includes a bottom wall 22, a side wall 24 and a common end wall 26. End walls 26 are provided with an overflow outlet 28 for directing a wash liquid to an adjacent collection chamber 20. As shown in FIG. 1, overflow outlets 28 are placed at sequentially increasing heights to retain an increased volume of wash liquid toward discharge end 14 of apparatus 10. In this manner, wash liquid is successively directed from collection chamber 20 adjacent discharge end 14 and successively carried upstream to a collection chamber toward receiving end 12. Each collection chamber 20 includes an outlet 30 connected to a pump 32 for circulating rinse liquid from each collection chamber 20 to a respective rinse tank 18 through a pipe 34.

A plurality of upper and lower pinch rollers 36 and 38, respectively, are spaced along the advancing direction of the strip and are provided to separate each spray station 16. As shown in FIG. 1, pinch rollers 36 and 38 are positioned directly above respective end walls 26 of each collection chamber 20. Pinch rollers 36 and 38 are spaced apart a distance to feed a continuous strip material 40 from receiving end 12 to discharge end 14 of apparatus 10. A suitable drive mechanism (not shown) as known in the art is connected to each pinch roller 36 and 38 to advance strip 40 through apparatus 10. Preferably, pinch rollers 36 and 38 have a substantially smooth cylindrical outer face for squeezing and removing rinse liquid from strip 40 as it is advanced through apparatus 10. Pinch rollers 36 and 38 substantially prevent the rinse liquid from a rinse station from being carried to a subsequent rinse station.

In the embodiment illustrated, spray station 16 adjacent receiving end 12 initially rinses strip 40 with a rinse solution previously discharged from the downstream rinse stations. Each successive rinse station in the advancing direction of strip 40 rinses strip 40 with increasingly diluted rinse liquid to clean and rinse strip 40 in successive stages. Preferably, the rinse station 16 that is adjacent discharge end 14 is continuously supplied with fresh water so that the final rinse removes substantially all of the pickling acid from the strip 40.

Figure 2:
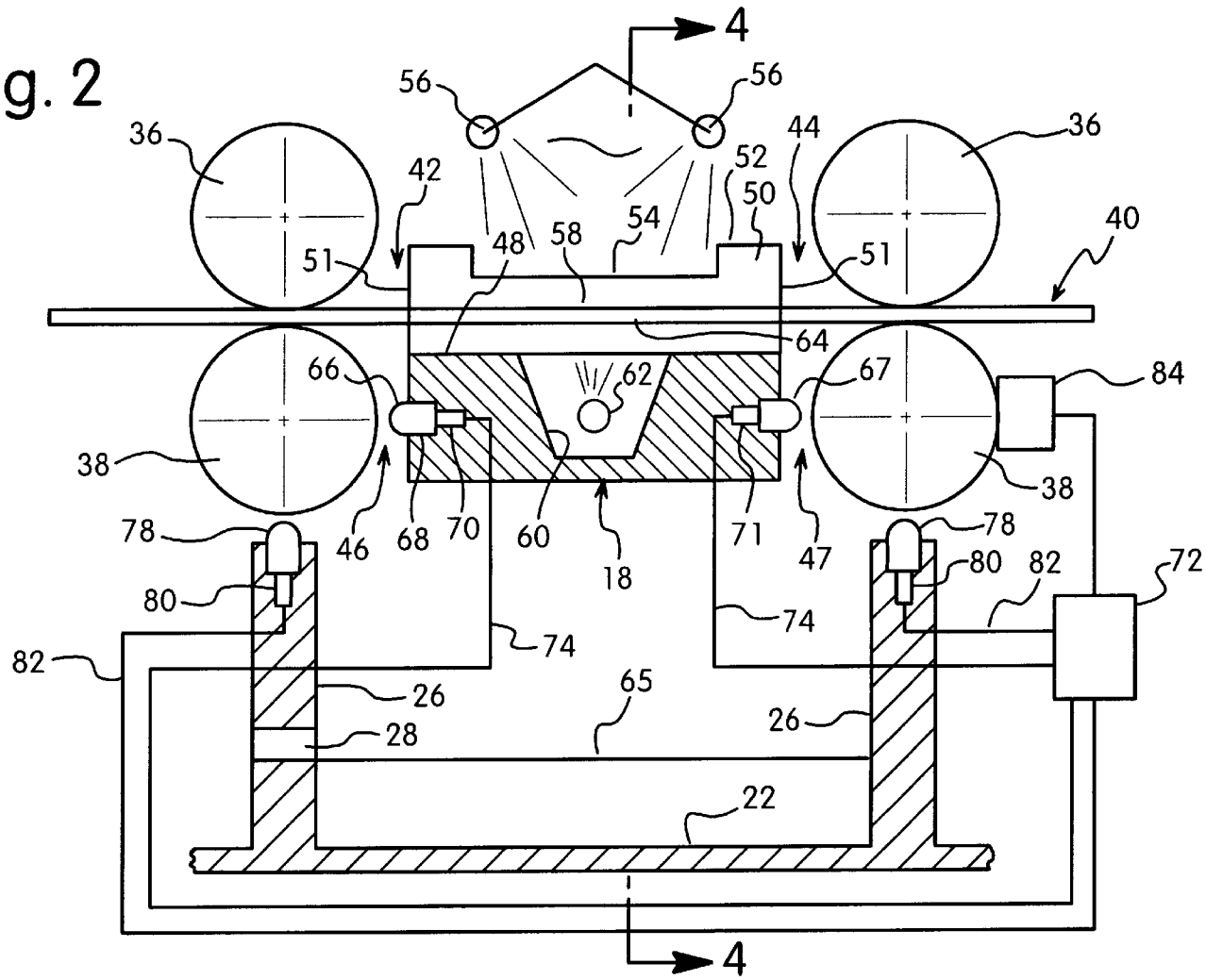
FIG. 2 is a cross-sectional side view of a rinse tank of the embodiment of FIG. 1 showing the pinch rollers at the inlet end and the outlet end of the rinse tank and the seals in the open position for draining the rinse liquid.
Figure 4:
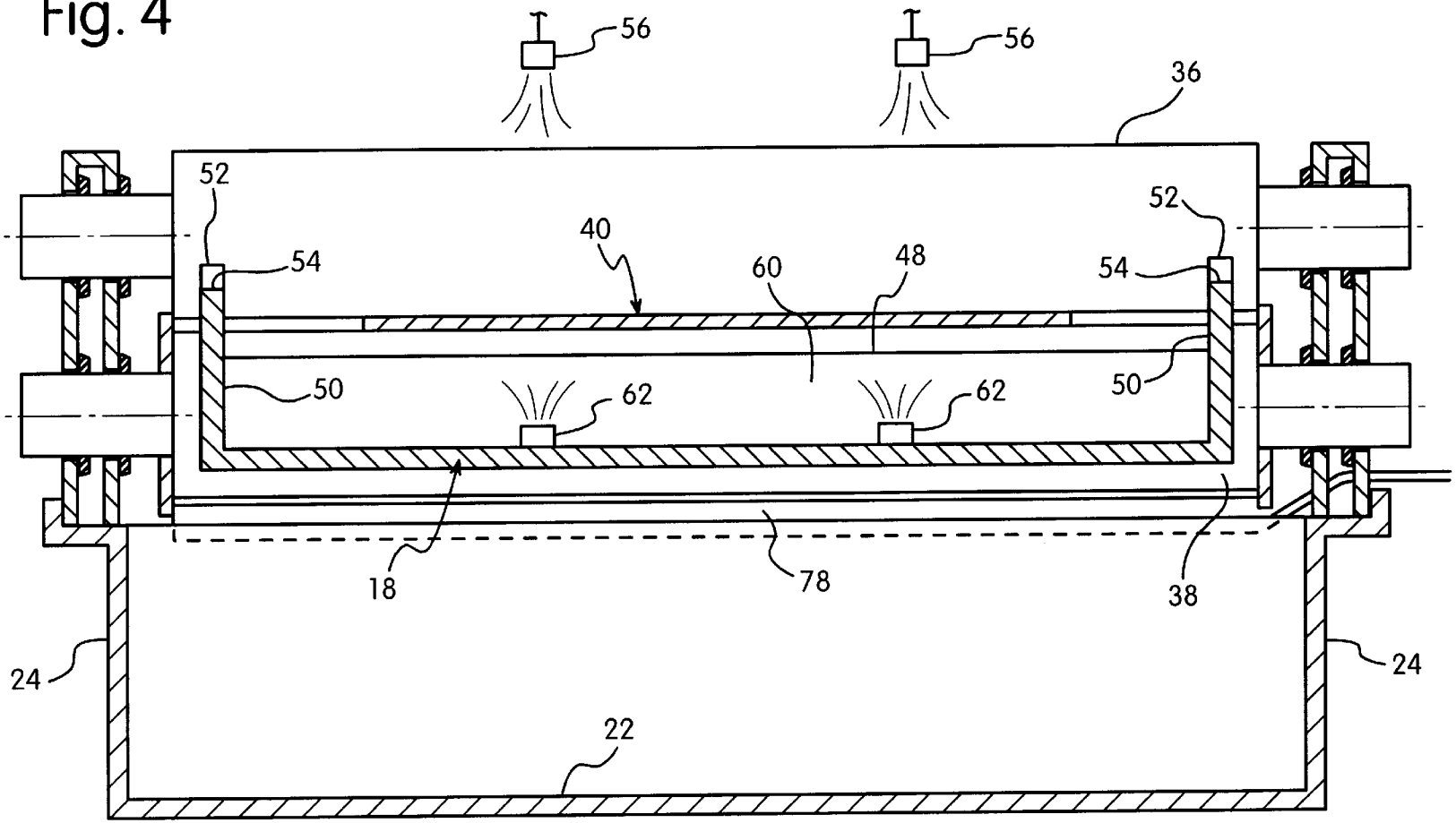
FIG. 4 is an end view in cross-section of the rinse apparatus taken along line 4—4 of FIG. 2.

As shown in FIG. 2, each rinse tank 18 extends between lower pinch rollers 38 of two sets of consecutive sets of rollers. Rinse tank 18 includes a receiving end 42 and a discharge end 44. Receiving end 42 and discharge end 44 are closely spaced a distance from a respective lower pinch roller 38 to define a gap 46 and a gap 47, respectively. A bottom wall 48 of tank 18 extends between receiving end 42 and discharge end 44. Preferably, bottom wall 48 has a width complementing the longitudinal length of pinch rollers 36 and 38 and a width to receive strip 40 as shown in FIG. 4. Rinse tank 18 includes opposite side walls 50 extending from the side edges of bottom wall 48 and extending in a substantially upward direction perpendicular to bottom wall 48. Side walls 50 include a top edge 52 having a recess 54 for defining a rinse liquid overflow as discussed hereinafter in greater detail. Side walls 50 include opposite ends 51 that are closely spaced to pinch rollers 36 and 38.

Each rinse tank 18 includes upper spray nozzles 56 for directing a shower of rinse liquid onto a top surface 58 of strip material 40 as strip material is continuously carried through each spray rinse station 16. As shown in FIG. 2, bottom wall 48 of rinse tank 18 includes a recess 60 extending between side walls 50. A lower spray nozzle 62 is positioned in recess 60 for directing a spray of rinse liquid in an upward direction onto a bottom surface 64 of strip material 40. Upper and lower spray nozzles 56 and 62, respectively, are connected to pipe 34 for receiving rinse liquid from pump 32.

During operation of apparatus 10, strip material 40 is advanced from receiving end 12 to discharge end 14 of apparatus 10 and between upper and lower controllers 36 and 38, respectively. Preferably, the sets of rollers 36 and 38 are spaced along the length of apparatus 10 to support strip 40 with minimal sag between the sets of rollers. Bottom wall 48 of rinse tank 18 is closely spaced to strip 40 without contacting strip 40 to define a small bath area within rinse tank 18.

As shown in FIG. 1, rinse liquid 65, which is typically water, is withdrawn from collection chamber 20 through a respective pipe 34 and continuously delivered to nozzles 56 and 62 where the rinse liquid is sprayed onto the moving strip 40. The rinse liquid continuously drains off of strip 40 and flows through gaps 46 and 47 back into collection chamber 20 where the rinse liquid is recycled.

At various times during the rinsing of the strip material 40, the forward movement of strip material 40 often comes to a standstill. The forward movement of strip material 40 can be stopped for only limited periods of time before oxidation and staining occurs. Since the strip material is in contact with air and rinse water during the stoppage, oxidation and staining can occur on the surface of the strip material, unless the strip material is completely immersed in a bath or pool of the rinse liquid.

Referring again to FIG. 2, rinse tank 18 includes a movable seal 66 on receiving end 42 and a movable seal 67 on discharge end 44. Seal 66 is received in a slot 68 in receiving end 42 of rinse tank 18. Movable seal 67 is received in a slot 69 in discharge end 44. Preferably, movable seals 66 and 67 extend the entire length of lower pinch roller 38 and the width of rinse tank 18. A seal actuating member 70 is mounted within bottom wall 48 of rinse tank 18 at receiving end 42 adjacent movable seal 66 for moving seal 66 within slot 68. A similar seal actuating member 71 is mounted at discharge end 44 of rinse tank 18 for moving seal 67. Seal actuating members 70 and 71 are pneumatic or hydraulically operated cylinders for moving seals 66 and 67, respectively. Seal actuating members 70 and 71 are connected to a control device 72 by lines 74. Control device 72 is typically a hydraulic or pneumatic pump for supplying pressure to seal actuating member 70.

As shown in FIG. 2, each end wall 26 of chamber 20 includes a slot 76 at an upper end for receiving a seal 78. A seal actuating member 80 is positioned in end wall 26 for operating seal 78. Seal actuating member 80 is also connected to control device 72 by a line 82.

A detecting device 84 is provided for detecting changes in speed and stoppages of the advancing movement of strip material 40. In the embodiment illustrated, detecting device 84 is connected to lower pinch roller 38 since rotation of pinch roller 38 provides an indication of movement of strip material 40. It will be appreciated that detecting device 84 can directly contact strip 40 or be coupled to the feed assembly for obtaining an indication of movement and stoppage of strip 40. Detecting device 84 is coupled to control device 72 to actuate the seal actuating members in response to changes in advancing speed of strip material 40.

During operation, strip material 40 is advanced through each rinse station 16 where rinse water is sprayed onto strip material 40. Under normal operating conditions, seals 66 and 67 are in the retracted position shown in FIG. 2 so that the rinse water flows through gaps 46 and 47 into collection chamber 20. In the event detecting device 84 senses a stoppage or decrease in speed of the advancing movement of strip material 40 that will result in oxidation and staining of strip material 40, detecting device 84 sends a signal to control device 72 to actuate seal actuating members 70 and 71. When this occurs, seal actuating members 70 and 71 move seals 66, 67 and 78 into contact with lower pinch rollers 38 as shown in FIG. 3 to provide a substantially fluidtight seal in rinse tank 18.

Seals 66 effectively close gaps 46 and 47 between pinch roller 38 and bottom wall 22 of rinse tank 18. Closing gaps 46 and 47 while continuing to spray the rinse water through nozzles 56 and 62 onto strip 40 causes the rinse water to form a pool 86 in rinse tank 18 such that the level of the pool rises above strip 40 to overflow outlet 28 in side walls 24.

The rinse water is continuously sprayed at a rate sufficient to form pool 86 to completely immerse strip 40 in rinse tank 18. Since bottom wall 48 of rinse tank 18 is closely spaced to strip 40, the space between strip 40 and rinse tank 18 is filled quickly to immerse strip 40 in the rinse liquid. Preferably, seals 78 form a fluidtight seal against lower pinch rollers 38 to prevent the flow of rinse water from one collection chamber 20 to an adjacent collection chamber. Ends 51 of side walls 50 are closely spaced to rollers 36 and 38 to define a sufficiently small gap that rinse tank 18 fills with liquid when seals 66 and 67 are closed. Although rinse liquid continuously drains from tank 18 between ends 51 and rollers 36 and 38, spray nozzles 56 and 62 are able to supply sufficient rinse liquid at a rate to fill rinse tank 18.

Figure 3:
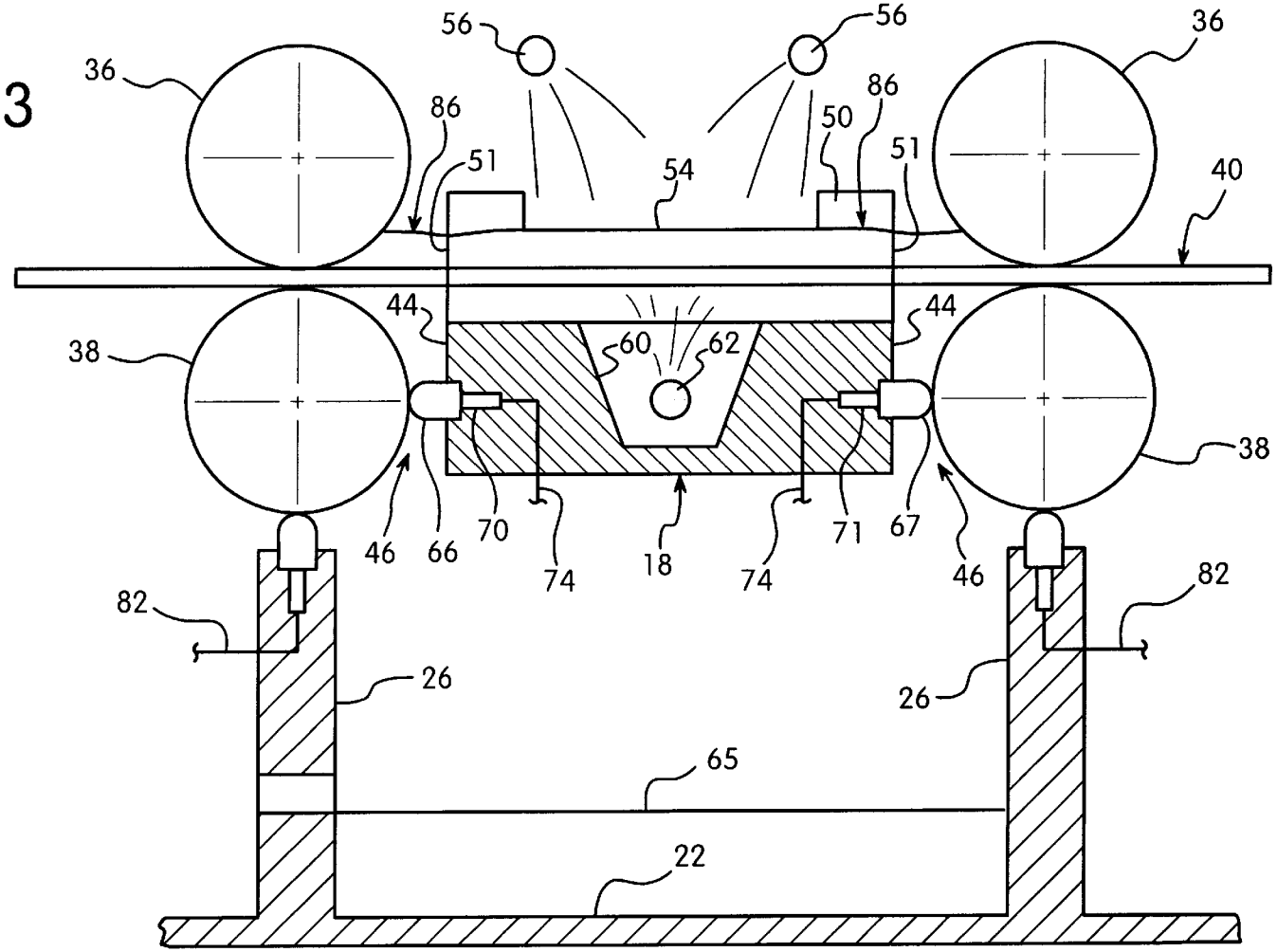
FIG. 3 is a side view in partial cross-section of the rinse tank of FIG. 2 showing the seals in the closed position contacting the pinch rollers.

Control device 72 actuates seal actuating members 70 and 80 during stoppage of strip material 40 to maintain the rinse water pool 86 in rinse tank 18 as shown in FIG. 3. When the forward movement of strip material 40 begins, detecting device 84 senses the forward movement and sends a signal to control device 72 to retract seals 66, 67 and 78 to the position of FIG. 2. This allows pool 86 to drain quickly through gaps 46 and 47 into the respective collection chamber 20. In preferred embodiments, seals 66, 67 and 78 are retracted immediately or prior to the forward movement of strip material 40.

It is desirable to limit contact of the seals with controllers 38 while the rollers are rotating to minimize wear on the seals. Seals 66 and 78 can be made of any suitable material capable of forming a fluidtight seal against pinch roller 38. For example, seals 66 and 78 can be made of steel or resilient polymeric materials. The resilient seals are preferred since they are relatively inexpensive and can conform to the shape of the pinch roller and provide proper and effective sealing even against a worn surface of a pinch roller.

As shown in FIGS. 2 and 3, rinse tank 18 extends between pinch rollers 36 and 38 and is spaced closely to strip material 40. The volume defined by rinse tank 18 is very small in comparison to the overall volume of each rinse spray station 16. In this manner, rinse tank 18 can be flooded very quickly when seals 66 are closed to completely immerse strip material 40 and prevent oxidation and staining of the strip. In a similar manner, rinse tank 18 can be drained very quickly once seals 66 and 67 are retracted to allow the rinse water to flow through gaps 46 and 47.

Since the volume of rinse tank 18 is small and rinse tank 18 can be flooded very quickly, a time delay is provided in detecting device 84 to delay closing of gap 46 and filling of rinse tank 18. In preferred embodiments, a timing delay is provided in detecting device 84 so that rinse tank 18 is flooded after a predetermined period of time has lapsed that would otherwise cause oxidation and staining of the strip material 40. In this fashion, stoppages in the advancing of the strip material 40 for short periods of time that will not cause oxidation or staining will not cause needless flooding of rinse tank 18. In preferred embodiments, a delay of about 5 seconds to about 2 minutes is provided in detecting device 84. The actual time delay will vary depending on the material being rinsed, the dimensions of rinse tank 18, and the time required to flood rinse tank 18 to completely immerse strip material in the rinse water. Other factors that can effect the time delay include the operating conditions of the rinsing apparatus, the properties of the strip material being rinsed, and the rinsing liquid.

The comparatively small volume of rinse tank 18 allows the elimination of the controllers and valves of the prior devices. In addition, the various inlet pipes and drain pipes of the prior devices are not required, thereby reducing the overall cost of the apparatus. The pump for feeding the rinse liquid to the spray nozzles also supplies the rinse liquid in the flooding stage to eliminate the need for additional pumps or excess capacity to achieve flooding of the rinse tank within the desired time.

While various embodiments have been chosen to illustrate the invention, it will be understood by those skilled in the art that various additions and modifications can be made without departing from the scope of the invention as defined in the appended claims.

What is claimed is:

1. A process for rinsing a strip material, comprising:

continuously feeding a strip material through a rinse tank, said rinse tank having an inlet for receiving said strip material and an outlet for discharging said strip material, said rinse tank further having a first pair of pinch rollers disposed in said inlet and spaced from said tank to define a first gap, and a second pair of pinch rollers disposed at said outlet and spaced from said tank to define a second gap, said strip material being carried by said first and second pairs of pinch rollers through said tank;

continuously spraying a rinse liquid onto said strip material carried through said tank;

detecting a stoppage of said strip material being carried through said rinse tank; and closing said first and second gaps between said tank and said first and second pairs of pinch rollers, respectively, to form a rinse liquid pool in said tank having a depth to immerse said strip material in said tank during said stoppage.

2. The process of claim 1, wherein said rinse tank comprises a first removable seal at said inlet for engaging said first lower pinch roller, and a second movable seal at said outlet for engaging said second lower pinch roller, said process comprising actuating said seals to close said gaps.

3. The process of claim 2, wherein said rinse tank includes a first actuator at said inlet for actuating said first seal and a second actuator at said outlet for actuating said second seal, said process comprising actuating said first and second actuators to close said gaps.

4. The process of claim 3, wherein said actuators are selected from the group consisting of pneumatic actuators and hydraulic actuators.

5. The process of claim 1, comprising providing a time delay for a predetermined time period between said step of detecting said stoppage and said step of closing said gaps.

6. The process of claim 5, wherein said time delay is about 5 seconds to about 2 minutes.

7. A rinsing apparatus for rinsing a continuously advancing strip material, said apparatus comprising:

at least one rinse chamber having an inlet end with an inlet for receiving a strip material, and an outlet end with an outlet for discharging said strip material;

a plurality of spray nozzles positioned in said rinse chamber for supplying a continuous spray of rinse liquid onto said strip material within said rinse chamber; and first upper and lower pinch rollers at said inlet end and second upper and lower pinch rollers at said outlet end;

a first sealing device positioned at said inlet end of said rinse chamber and a second sealing device positioned at said outlet end of said rinse chamber, said first sealing device being positioned to engage said first lower pinch roller to close said inlet end, and said second sealing device being positioned to engage said second lower sealing device to close said outlet end and cause said rinse liquid to pool in said rinse chamber to a level to immerse said strip material in said rinse liquid.

8. The apparatus of claim 7, wherein said rinse chamber comprises a first seal actuating member for moving said first sealing device and a second seal actuating member for moving said second sealing device.

9. The apparatus of claim 8, wherein said first and second seal actuating members are selected from the group consisting of pneumatic actuators and hydraulic actuators.

10. The apparatus of claim 7, further comprising a collection chamber positioned below said rinse chamber for collecting rinse liquid from said rinse chamber.

11. The apparatus of claim 7, wherein said rinse chamber includes an overflow outlet to drain said rinse liquid from said rinse chamber when said level reaches a predetermined height.

12. The apparatus of claim 11, wherein said rinse chamber includes a side wall and said overflow outlet being formed in said side wall.

13. The apparatus of claim 7, wherein said rinse chamber has a bottom wall with a top surface, said top surface of said bottom wall having a recess and a spray nozzle in said recess for directing an upward spray of said rinse liquid.

14. The apparatus of claim 7, further comprising a control device for actuating said first and second sealing devices to close said inlet and outlet.

15. The apparatus of claim 14, further comprising a detecting device for detecting a stoppage of said strip material, said detecting device being operatively connected to said control device for sending a signal to said control device when a stoppage is detected for actuating said control device.

16. The apparatus of claim 15, wherein said detecting device includes a time delay between detecting a stoppage and sending said signal to said control device.

17. The apparatus of claim 16, wherein said detecting device has a 5 second to 2 minute delay between detecting a stoppage and sending said signal to said control device.

18. The apparatus of claim 7, wherein said first lower pinch roller is spaced from said rinse chamber to define a first gap at said inlet end to allow said rinse liquid to drain from said chamber, and said second lower pinch roller is spaced from said rinse chamber to define a second gap at said outlet end to allow said rinse liquid to drain from said chamber.

19. The apparatus for claim 18, wherein said first sealing device is movable to contact said first lower pinch roller to close said first gap and wherein said second sealing device is movable to contact said second lower pinch roller to close said second gap.

20. The apparatus of claim 7, wherein said first sealing device is movable between an open position and a closed position to close said inlet end and wherein said second sealing device is movable between an open position and a closed position to close said outlet end.

21. The apparatus of claim 7, wherein said inlet defines a first opening at said inlet end to allow said rinse liquid to drain from said chamber and said outlet defines a second opening at said outlet end to allow said rinse liquid to drain from said chamber, and wherein said first sealing device is movable to a sealing position to close said first opening and said second sealing device is movable to a sealing position to close said second opening.

22. A rinsing apparatus for rinsing a continuously advancing steel strip, said apparatus comprising a plurality of rinse stations arranged in a direction of travel of said advancing steel strip, each of said rinse stations comprising:

a rinse chamber having an inlet end with an inlet for receiving said steel strip and an outlet end with an outlet for discharging said steel strip;

at least one spray nozzle for directing a spray of rinse liquid onto said steel strip within said rinse chamber;

first upper and lower pinch rollers at said inlet end of said rinse chamber and defining a first gap between said first lower pinch roller and said rinse chamber;

second upper and lower pinch rollers at said outlet end of said rinse chamber and defining a second gap between said second lower pinch roller and said outlet end;

a first sealing device positioned at said inlet end of said rinse chamber for closing said first gap; and a second sealing device positioned at said outlet end of said rinse chamber for closing said second gap, said first and second sealing devices selectively closing said first and second gaps to cause said rinse liquid to pool in said rinse chamber to cover said steel strip.

23. The apparatus of claim 22, further comprising a control device coupled to said first and second sealing devices for actuating said first and second sealing devices to close said first and second gaps.

24. The apparatus of claim 23, further comprising a detector for detecting a stoppage of said steel strip, said detector being coupled to said control device for actuating said first and second sealing devices when a stoppage is detected.

25. The apparatus of claim 22, wherein said rinse stations further comprise a collection chamber for collecting rinse liquid from said rinse chamber, said collection chamber having first and second ends with a movable sealing member for engaging first and second lower pinch rollers, respectively.

26. A rinsing apparatus for rinsing a continuously advancing strip material, said apparatus comprising:

a rinse chamber having an inlet with a first opening for receiving a strip material, and an outlet with a second opening for discharging said strip material;

a spray nozzle positioned in said rinse chamber for supplying a continuous spray of rinse liquid onto said strip material within said rinse chamber;

a first movable sealing device at said inlet of said rinse chamber and a second movable sealing device coupled to said outlet of said rinse chamber, said first and second movable sealing devices being movable from an open position to allow said rinse liquid to drain from said first opening and said second opening, respectively, to a closed position to close said first opening and second opening, respectively, to cause said rinse liquid to pool in said rinse chamber to a level to immerse said strip material in said rinse liquid; and a control device to operate said first sealing device and said second sealing device.

27. The apparatus of claim 26, wherein said control device operates said first sealing device and second sealing device in response to a signal indicating a stoppage of said strip material to close said first opening and said second opening.

28. The apparatus of claim 27, wherein said control device operates said first sealing device and said second sealing device in response to a signal indicating that said advancing strip material has resumed to open said first opening and said second opening to allow said rinse liquid to drain from said chamber.

29. A rinsing apparatus for rinsing a continuously advancing strip material, said apparatus comprising:

a rinse chamber having an inlet for receiving a strip material, and an outlet for discharging said strip material;

at least one spray nozzle positioned in said rinse tank for supplying a continuous spray of rinse liquid onto said strip material within said rinse chamber;

a first sealing device at said inlet of said rinse chamber and a second sealing device at said outlet of said rinse chamber, said first and second sealing devices being positioned to close said inlet and outlet and cause said rinse liquid to pool in said rinse chamber to a level to immerse said strip material in said rinse liquid;

a control device for actuating said first and said second sealing devices to open and close said inlet and said outlet; and a detecting device for detecting stoppage of said strip material, said detecting device being operatively connected to said control device for sending a signal to said control device when a stoppage is detected for actuating said control device and said detecting device having a time delay between detecting a stoppage and sending said signal to said control device.

30. The apparatus of claim 29, wherein said detecting device has a delay of about 5 seconds to about 2 minutes between detecting a stoppage and sending said signal to said control device.

31. A rinsing apparatus for rinsing a continuously advancing strip material, said apparatus comprising:

at least one rinse chamber having an inlet end with an inlet opening for receiving a strip material, and an outlet end with an outlet opening for discharging said strip material;

a first guide member positioned in said inlet opening for guiding said strip material into said chamber;

a second guide member positioned in said outlet opening for guiding said strip material from said chamber;

a spray nozzle positioned in said rinse chamber for supplying a continuous spray of rinse liquid onto said strip material within said rinse chamber; and a first movable sealing device positioned at said inlet opening of said rinse chamber and a second movable sealing device positioned at said outlet opening of said rinse chamber, said first and second sealing devices being movable between an open position to allow said rinse liquid to drain from said chamber through said inlet opening and said outlet opening and a closed position to close said inlet opening and outlet opening and cause said rinse liquid to pool in said rinse chamber to a level to immerse said strip material in said rinse liquid.

32. The apparatus of claim 31, wherein said first sealing device is movable to engage said first guide member to close said inlet opening and said second sealing device is movable to engage said second guide member to close said outlet opening.

* * * * *